US009194154B2

(12) United States Patent
Martin

(10) Patent No.: US 9,194,154 B2
(45) Date of Patent: Nov. 24, 2015

(54) PORTABLE SHELTER

(71) Applicant: Charles Martin, Euless, TX (US)

(72) Inventor: Charles Martin, Euless, TX (US)

( * ) Notice: Subject to any disclaimer, the term of this patent is extended or adjusted under 35 U.S.C. 154(b) by 0 days.

(21) Appl. No.: 13/952,656

(22) Filed: Jul. 28, 2013

(65) Prior Publication Data

US 2014/0158175 A1 Jun. 12, 2014

Related U.S. Application Data

(60) Provisional application No. 61/677,980, filed on Jul. 31, 2012.

(51) Int. Cl.
*E04H 15/48* (2006.01)
*E04H 15/58* (2006.01)

(52) U.S. Cl.
CPC ..... *E04H 15/58* (2013.01); *E04H 15/48* (2013.01)

(58) Field of Classification Search
CPC ..... E04H 15/50; E04H 15/58
USPC ..... 135/121, 145, 151, 153, 154, 117
See application file for complete search history.

(56) References Cited

U.S. PATENT DOCUMENTS

| | | | | |
|---|---|---|---|---|
| 225,372 | A | 3/1880 | Herbert | |
| 1,155,366 | A * | 10/1915 | Myers | 297/23 |
| 1,843,312 | A | 2/1932 | Ames | |
| 2,290,786 | A * | 7/1942 | Varady | 5/418 |
| 2,499,897 | A | 3/1950 | Winquist | |
| 2,853,088 | A * | 9/1958 | Lamborn | 135/132 |
| 3,131,704 | A | 5/1964 | Shimon | |
| 5,752,537 | A | 5/1998 | Kranzler | |
| 7,240,683 | B2 * | 7/2007 | Zutich | 135/87 |
| 7,931,040 | B2 * | 4/2011 | Holacka et al. | 135/154 |
| 8,176,928 | B2 | 5/2012 | Maginot | |

* cited by examiner

*Primary Examiner* — David R Dunn
*Assistant Examiner* — Danielle Jackson
(74) *Attorney, Agent, or Firm* — George M. Tompkins; Tompkins, P.C.

(57) ABSTRACT

The specification discloses a portable shelter which is conveniently transportable, easy to set up, and structurally stable in a variety a situations. The portable shelter comprises a canopy which is supported by opposing side support structures connected by a lateral support member and canopy support beams. The portable shelter can be disassembled and/or folded for convenient transportation.

7 Claims, 7 Drawing Sheets

PORTABLE SHELTER

PRIORITY CLAIMS

This application claims priority to U.S. Provisional Application No. 61/677,980, filed Jul. 31, 2012, which is hereby incorporated by reference.

TECHNICAL FIELD OF THE INVENTION

The present invention is generally directed to portable shelters, and in particular, to shelters that may be used for enjoyment of outdoor recreational activities.

BACKGROUND ART OF THE INVENTION

Many outdoor activities can be affected by weather and the elements. Even outdoor activities that rely on outdoor weather can be made less enjoyable by too much of a good thing. For example, people typically prefer sunny weather while lounging on a beach or near a pool. However, excessive sun exposure can cause discomfort, overheating, sunburns, and other problems. Additionally, bright sunlight can interfere with enjoyment of other activities while lounging, such as reading or using electronic devices. Accordingly, it is often desired to have a source of shade available. In some situations, protection from other weather conditions such as wind or rain is also desired.

Further, because shelter is often desired in locations where permanent structures do not exist or are unwanted, shelters which may be easily transported are often preferred. Many types of shelters are known and have been used, including some which are portable. However, all known prior art shelters suffer from one or more of the following problems: they are too heavy or bulky for convenient transport, too difficult to assemble, rely on external features for support, or suffer from instability when assembled.

SUMMARY

The inventions described herein provide a shelter which is conveniently transportable, easy to set up, and structurally stable in a variety a situations. The inventions include portable shelters comprising:

left-side and right-side support structure comprising a first side support member, a second side support member pivotally-connected to the first side support member, and an upper side support member that is hingedly-connected to an upper end of the second side support member, wherein the upper side support member comprises one or more attachment locations configured to engage an upper end of the first side support member;

a lateral support member comprising a bottom support member configured to engage the first left-side and first right-side support member, and a brace member hingedly attached to the bottom support member and configured to engage the first left-side support member or the first right-side support member;

a first canopy support beam configured to engage a first end of the left-side and right-side upper support members;

a second canopy support beam configured to engage a second end of the left-side and right-side upper support members; and a canopy configured to be secured between the first canopy support beam and at least one other location of the portable shelter.

all supports can be folded and placed into a bag for convenient transportation.

In certain embodiments, the portable shelter comprises a plurality of attachment points defined on the left-side and right-side upper support members and configured so that an angle of the left-side and right-side upper support members can be adjusted by selection from among the plurality of attachment points.

In other embodiments the portable shelter comprises elastic straps configured to secure the canopy to the lateral support member.

In some embodiments the canopy comprises a woven polyethylene fabric and or a UV resistant fabric.

In certain embodiments the portable shelter comprises a second brace member configured to engage the other side support member.

BRIEF DESCRIPTION OF THE DRAWINGS

The disclosed inventions will be described with reference to the accompanying drawings, which show important sample embodiments and which are incorporated in the specification hereof by reference, wherein.

DETAILED DESCRIPTION OF THE PREFERRED EMBODIMENTS

Figure 1:
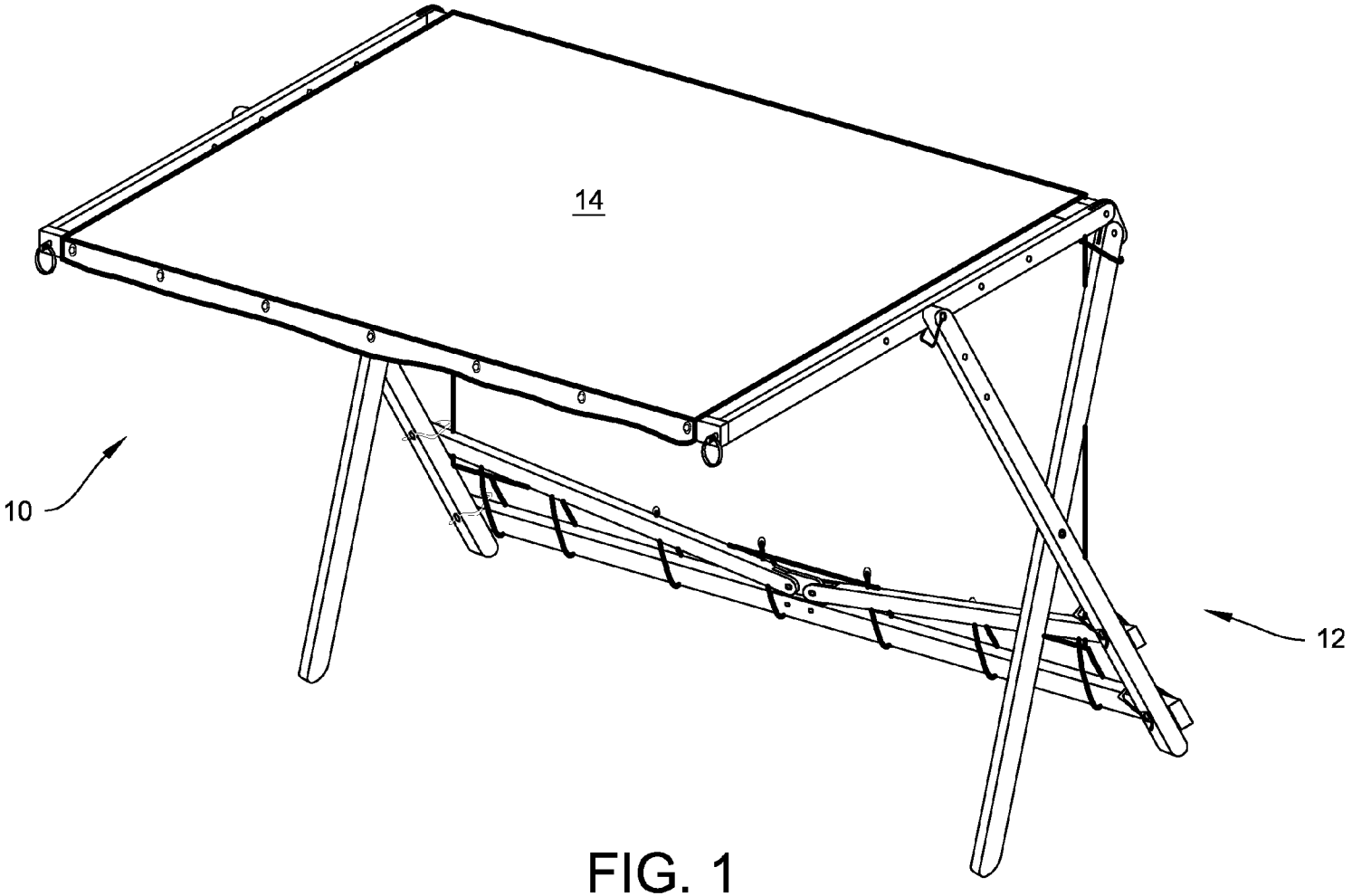
FIG. 1 is a perspective view of a portable shelter.

FIG. 1 shows a perspective view of a portable shelter 10 employing certain aspects of the present inventions. Portable shelter 10 preferablely comprises a frame 12 and a canopy 14.

Figure 2:
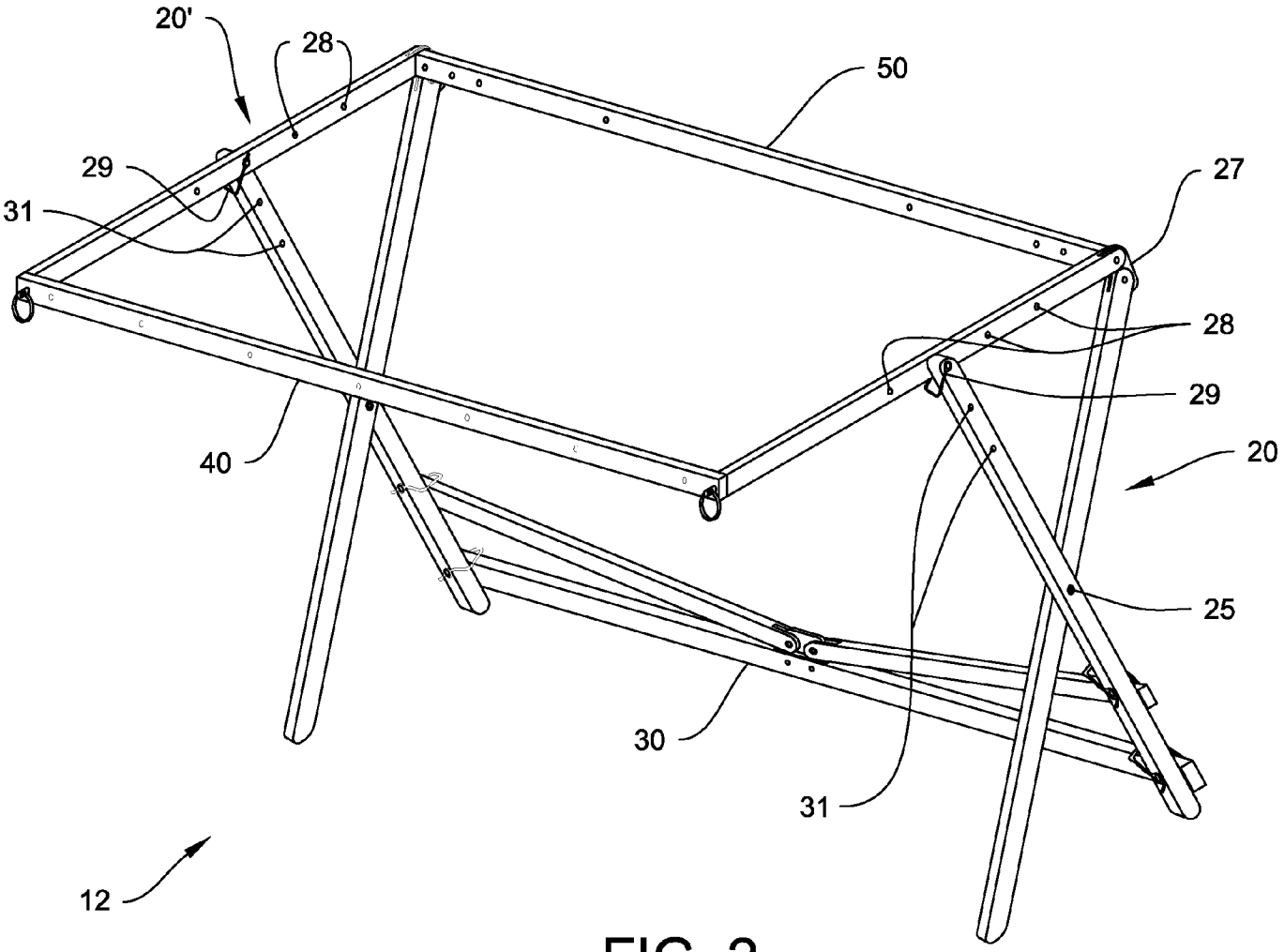
FIG. 2 is a perspective view of a portable shelter with canopy removed.

FIG. 2 is a perspective view of frame 12 without canopy 14. Frame 12 preferably comprises side support structures 20 and 20' located at opposing ends of frame 12, lateral support member 30, front canopy support member 40, and rear canopy support member 50.

Figure 3:
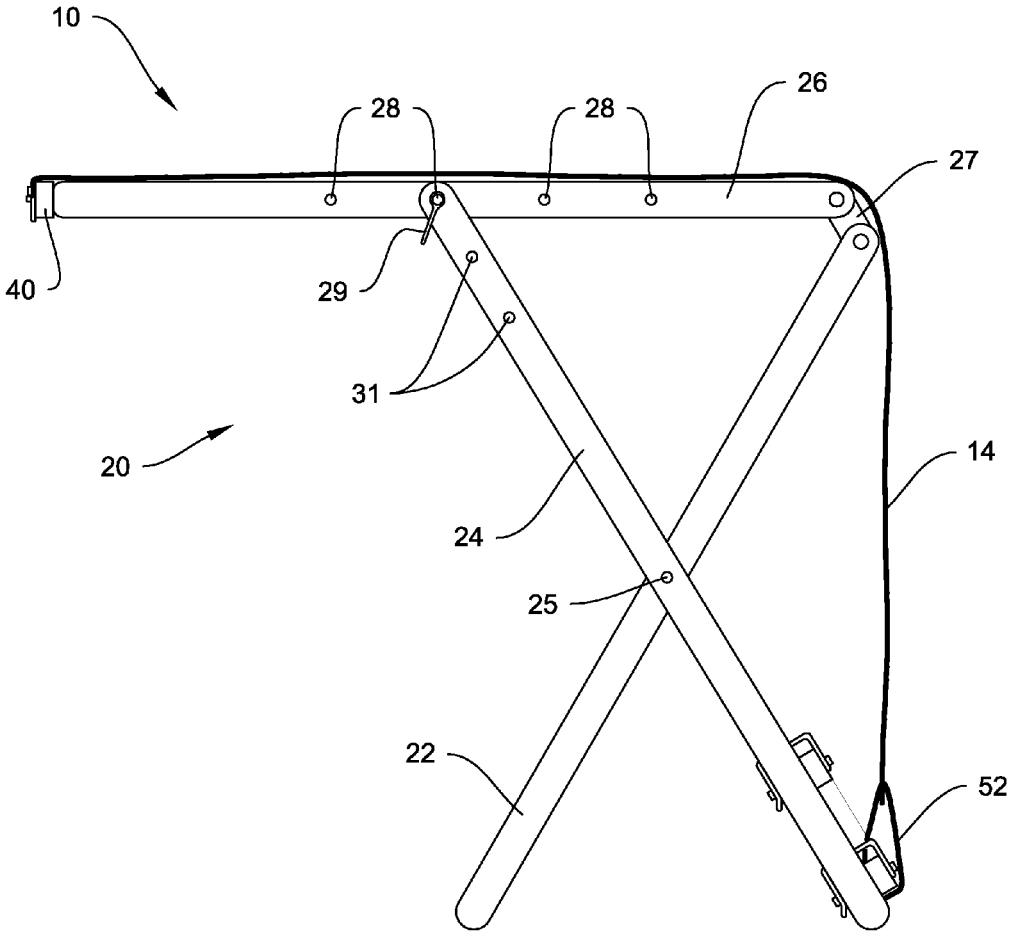
FIG. 3 is a side view of a portable shelter.

FIG. 3 is a side view of portable shelter 10 in which one side support structure 20 is easily seen. Side support structure 20 preferably comprises first support member 22, second support member 24, and upper support member 26. First support member 22 is preferably hingedly attached to outer support member 24, e.g., by a hinge pin 25. First support member 22 is preferably hingedly attached to upper support member 26, e.g., by a double-holed plate 27. Alternatively to hinged attachments, components of side support structure 20 can be configured to be selectively detachable from others.

Second support member 24 is preferably attachable to upper support member 26 at one or more locations. In the embodiment shown in FIG. 3, four attachment holes 28 are defined in upper support member 26. Each attachment hole 28 represents a potential attachment location for second support member 24.

For additional flexibility, additional attachment points 25 can be defined on second support member 24. Second support member 24 can be attached to upper support member 26 by inserting a removable pin 29 through a hole defined in outer support member 26 and through one of attachment holes 28.

Preferably, frame 12 comprises a second side support structure 20' that is a mirror-image of a first side support structure 20. Alternatively, second side support structure 20' can be identical to first side support structure 20, rather than a mirror-image, or can be another variation.

Figure 4:
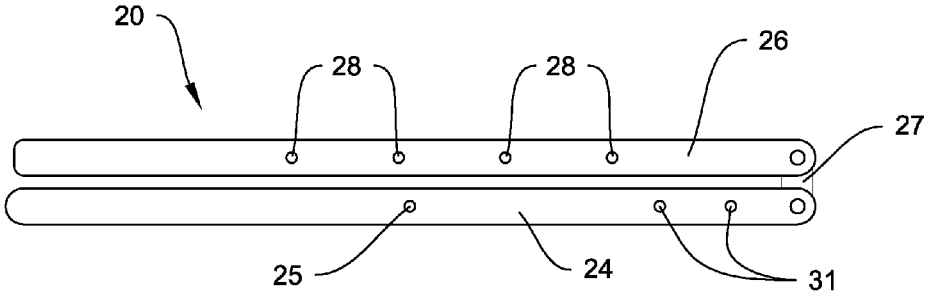
FIG. 4 is an illustration of a side support structure for a portable shelter in a folded configuration.

At least some components of side support structure 20 are preferably configured to be foldable to increase convenience of transport. FIG. 4 shows side support structure 20 in a folded configuration. To fold side support structure 20, second support member 24 is preferably disconnected from upper support member 26. Upper support member 26, first support member 22, and second support member 24 are then preferably moved to adjacent, parallel positions.

Figure 5:
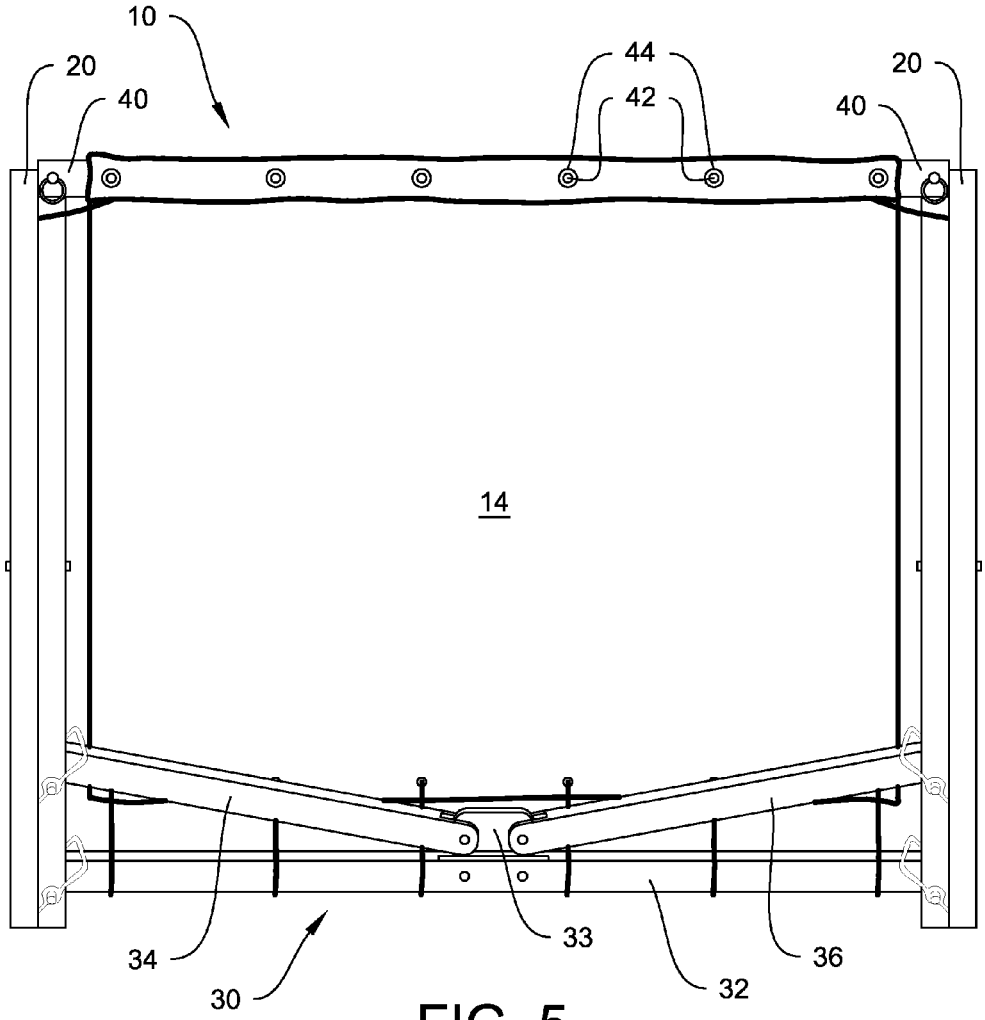
FIG. 5 is a front view of a portable shelter.

FIG. 5 is a front view of portable shelter 10 showing lateral support member 30. Lateral support member 30 comprises bottom support member 32, left-side brace 34, and right-side brace 36. Left-side brace 34 and right-side brace 36 are preferably hingedly-attached to bottom support member 32. Most preferably, a plate 33 with two defined holes is attached to bottom support member 32. Left-side brace member and right-side brace member are rotably-attached to the holes in plate 33.

Also visible in FIG. 5 is front canopy support member 40 and canopy 14. Canopy 14 is preferably affixed to front canopy support member 40 by brads 42 placed through canopy-attachment holes 44 defined in canopy 14. Canopy-attachment holes 44 are preferably reinforced using grommets. Alternatively, canopy 14 may be attached to front canopy support member 40, by screws, staples, glue or other means. Canopy 14 preferably comprises a woven polyester material or lightweight, yet durable material.

Attachment holes are preferably defined near each end of front canopy support member 40. Attachment holes are configured to engage a front most end of upper support members 26.

Figure 6:
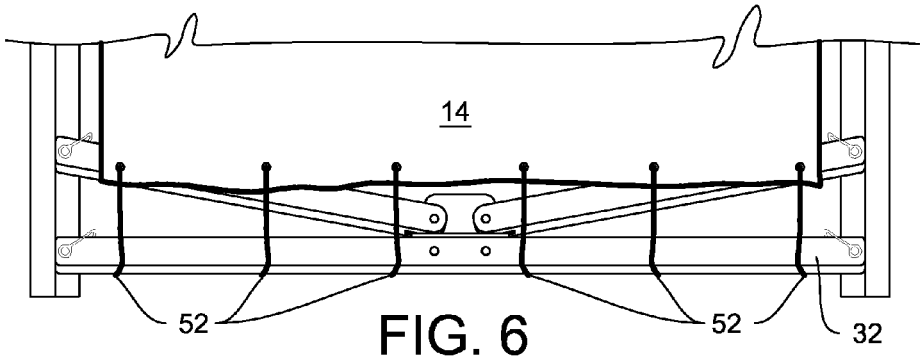
FIG. 6 is a rear view of lateral support member of a portable shelter with attached canopy.
Figure 7:
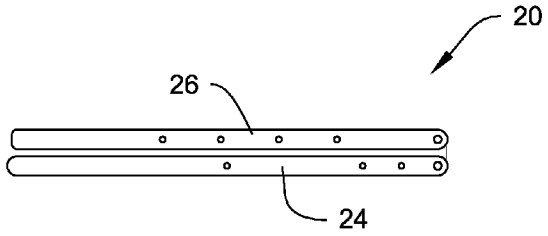
FIGS. 7-14 illustrate assembly of a portable shelter.
Figure 8:
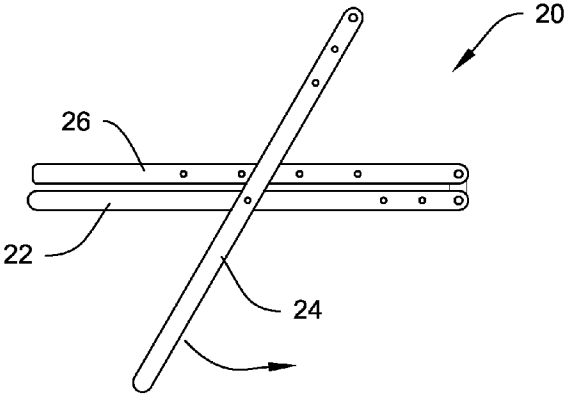
Figure 9:
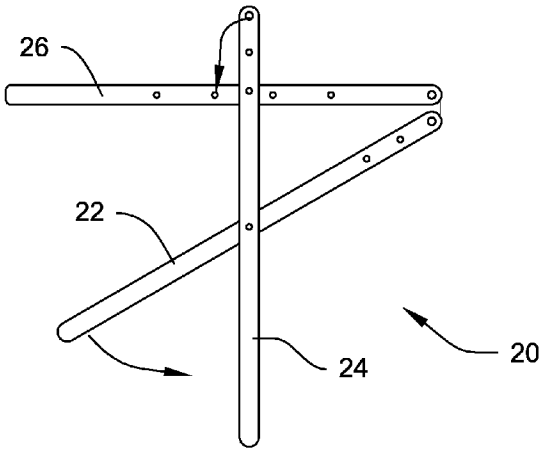
Figure 10:
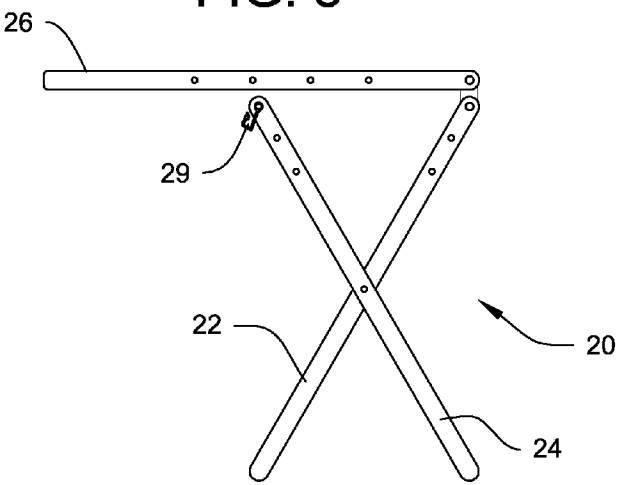
Figure 11:
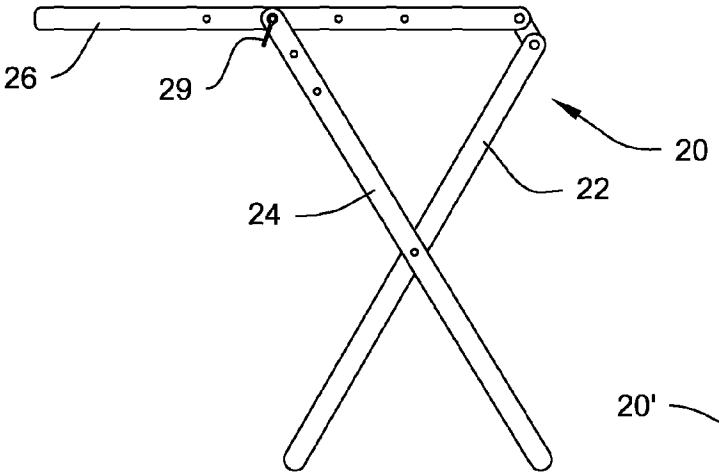

FIG. 6 is a rear view of lateral support member 30 with attached canopy 14. In this view, canopy 14 is shown with elastic straps 52 extending around bottom support member 32. Elastic straps 52 preferably extend from canopy attachment holes 44 defined along an edge of canopy 14. Elastic straps 52 are configured to secure canopy 14 to frame 12. Optionally, the endmost elastic straps 52 can extend around second support member 24 and bottom support member 32.

Components of frame 12 are preferably composed of rigid, relatively lightweight, and weather-resistant materials such as wood, plastic, fiberglass, or metal tubing. Most preferably, larger elements of frame 12 are composed of a weather-resistant wood such as teak or treated oak, while joints, pins, and other small elements are composed of aluminum or stainless steel. Canopy 14 can comprise any of many known fabrics such as woven polyethylene, polyester, nylon, cotton, or a blended fabric. Most preferably, canopy 14 comprises UV-resistant woven polyethylene.

FIGS. 7-14 illustrate one process for assembling a portable shelter. First, as shown in FIGS. 7-11, side-support structures 20, 20' are assembled.

Figure 12:
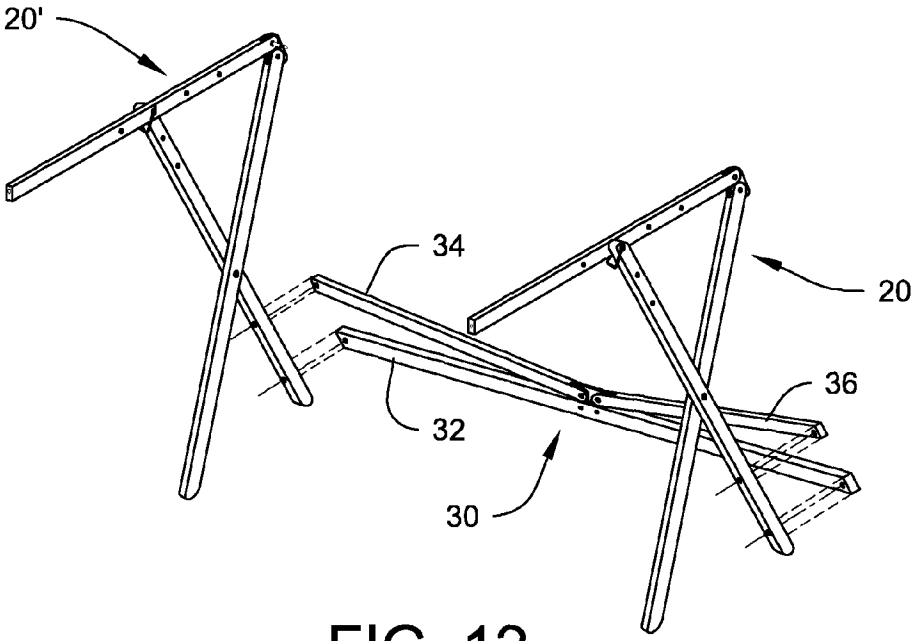

Next, side support structures 20, 20' are lifted upright and attached to lateral support member 30, as shown in FIG. 12. A first end of bottom support member 32 is attached to first side support structure 20 and a second end of bottom support member 32 is attached to a second side support structure 20'. The attachments are preferably removable, e.g., by removable pin. Next, left-side brace 34 is attached to first side support structure 20 and right-side brace 36 is attached to second side support structure 20'.

Figure 13:
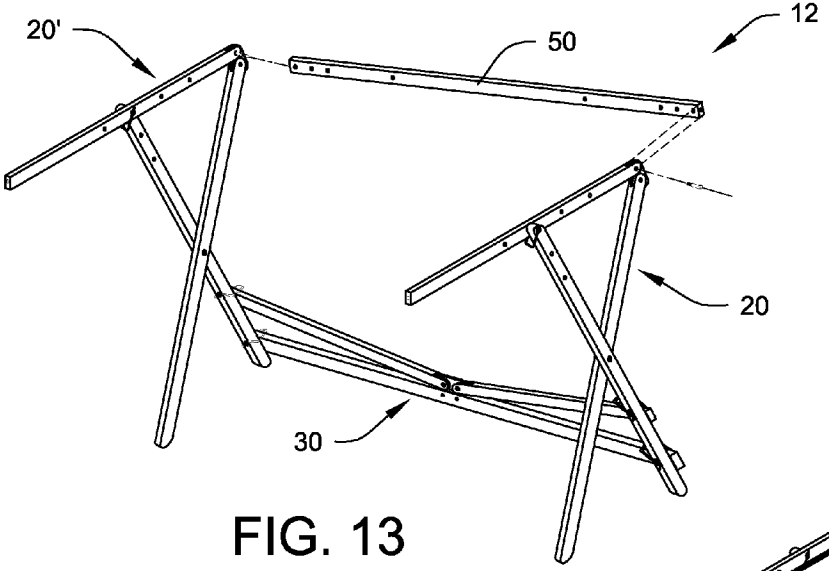
Figure 14:
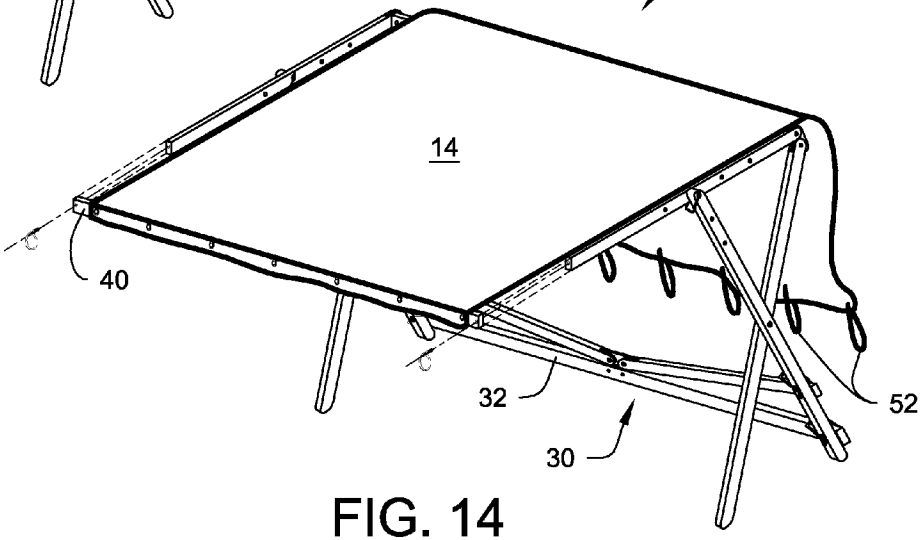

Then, rear canopy support member 50 is connected to side support structures 20, 20', as shown in FIG. 13. Next, front canopy support member 40 is connected between side support structures 20 and 20', as shown in FIG. 14. Finally, a back edge of canopy 14 is connected to bottom support member 32 by elastic straps 52. In the embodiment shown in FIG. 14, canopy 14 is permanently attached to front canopy support member 40. Canopy 14 can be rolled up around front canopy support member 40 for transport or storage. Alternatively, canopy 14 can be made detachable from front canopy support member 40.

When disassembled and/or folded, portable shelter 10 can be placed in a bag, tote, backpack, or similar container for convenient transporation.

Although the invention has been described with reference to specific embodiments, this description is not meant to be construed in a limiting sense. Various modifications of the disclosed embodiments, as well as alternative embodiments of the inventions, will be apparent to persons skilled in the art upon reference to the description of the invention. It is, therefore, contemplated that the appended claims will cover such modifications that fall within the scope of the invention.

I claim:

1. A portable shelter comprising:

a left-side support structure comprising a first rigid left-side support member with a bottom end configured to contact the ground, a second rigid left-side support member with a bottom end configured to contact the ground pivotally-connected to the first left-side support member, and an upper left-side support member that is hingedly-connected to an upper end of the second left-side support member, wherein the upper left-side support member comprises one or more attachment locations configured to engage an upper end of the first left-side support member;

a right-side support structure comprising a first rigid right-side support member with a bottom end configured to contact the ground, a second rigid right-side support member with a bottom end configured to contact the ground pivotally-connected to the first right-side support member, and an upper right-side support member that is hingedly-connected to an upper end of the second right-side support member, wherein the upper right-side support member comprises one or more attachment locations configured to engage an upper end of the first right-side support member;

a lateral support member comprising a bottom support member extending between first left-side support member and the first right-side support member, and a first rigid brace member hingedly attached to the bottom support member and configured to engage the first left-side support member or the first right-side support member, thereby forming a triangle comprising the first rigid brace member, a portion of the bottom support member, and a portion of the first left-side support member or the first right-side support member;

a first canopy support beam configured to engage a first end of the left-side and right-side upper support members;

a second canopy support beam configured to engage a second end of the left-side and right-side upper support members; and a canopy configured to be secured between the first canopy support beam and at least one other location of the portable shelter.

2. The portable shelter of claim 1 further comprising a second rigid brace member hingedly connected to bottom support member and configured to engage the other of first left-side support member or first right-side support member, thereby forming a triangle comprising the second rigid brace member, a portion of the bottom support member, and a portion of the other of the first left-side support member or the first right-side support member.

3. The portable shelter of claim 1 further comprising:

two or more attachment locations defined on the left-side upper support member and configured to engage an upper end of the first left-side support member so that an angle of the left-side upper support member with respect to the ground can be adjusted by selection from among the two or more attachment locations; and two or more attachment locations defined on the right-side upper support member and configured to engage an upper end of the first right-side support member so that an angle of the left-side and right-side upper support members with respect to the ground can be adjusted by selection from among the two or more attachment locations.

4. The portable shelter of claim 1 further comprising a plurality of elastic straps configured to secure the canopy to the lateral support member.

5. The portable shelter of claim 1 wherein the canopy comprises a woven polyethylene fabric.

6. The portable shelter of claim 5 wherein the canopy comprises a UV resistant fabric.

7. The portable shelter of claim 1 further comprising:

a plurality of canopy attachment brads extending from the front canopy support beam; and a plurality of canopy attachment holes defined in the canopy and configured to engage two or more of the canopy attachment brads.

* * * * *